US010986942B2

(12) United States Patent
Wood et al.

(10) Patent No.: US 10,986,942 B2
(45) Date of Patent: Apr. 27, 2021

(54) CONFIGURABLE STORAGE SYSTEM

(71) Applicants: Holland J. Wood, Henderson, NV (US); Stephanie Ann Wood, Henderson, NV (US)

(72) Inventors: Holland J. Wood, Henderson, NV (US); Stephanie Ann Wood, Henderson, NV (US)

( * ) Notice: Subject to any disclaimer, the term of this patent is extended or adjusted under 35 U.S.C. 154(b) by 0 days.

(21) Appl. No.: 16/695,142

(22) Filed: Nov. 25, 2019

(65) Prior Publication Data

US 2020/0163471 A1 May 28, 2020

Related U.S. Application Data

(60) Provisional application No. 62/772,500, filed on Nov. 28, 2018.

(51) Int. Cl.

| | |
|---|---|
| ***A47F 5/08*** | (2006.01) |
| ***A47F 7/02*** | (2006.01) |
| ***A47B 77/14*** | (2006.01) |
| ***A47B 51/00*** | (2006.01) |

(52) U.S. Cl.

CPC ..... *A47F 5/0838* (2013.01); *A47B 77/14* (2013.01); *A47F 5/0869* (2013.01); *A47F 7/022* (2013.01); *A47B 2051/005* (2013.01)

(58) Field of Classification Search

CPC .... A47F 5/0838; A47F 5/0869; A47F 5/0846; A47F 5/0006; A47F 5/0892; A47F 7/02; A47F 7/022; A47H 1/04; A47H 2001/042; A47B 77/14; A47B 81/04; A47B 61/02; A47B 2051/005; A47J 47/16

USPC ..... 211/94.01, 94.02, 162, 113, 117, 85.29, 211/85.2, 105.1, 123

See application file for complete search history.

(56) References Cited

U.S. PATENT DOCUMENTS

| | | | | | |
|---|---|---|---|---|---|
| 699,971 | A * | 5/1902 | Poschmann | A47H 15/04 | 16/87.4 R |
| 1,060,426 | A * | 4/1913 | Carlson | A47H 15/04 | 16/87.4 R |
| 1,613,447 | A * | 1/1927 | Ellberg | A47B 61/003 | 211/123 |
| 2,606,666 | A * | 8/1952 | Gray | A47J 47/16 | 211/113 |
| 2,611,492 | A * | 9/1952 | Watts | A47G 25/02 | 211/113 |
| 2,715,966 | A * | 8/1955 | Tieck | A47H 15/02 | 211/94.01 |
| 2,787,435 | A * | 4/1957 | Shields | A47G 1/1686 | 248/307 |
| 2,966,695 | A * | 1/1961 | Dwyer | A47H 15/04 | 16/93 D |
| 3,027,015 | A * | 3/1962 | Miller | A47B 61/003 | 211/85.3 |

(Continued)

*Primary Examiner* — Jennifer E. Novosad
(74) *Attorney, Agent, or Firm* — Fenwick & West LLP

(57) ABSTRACT

A storage system includes a support bar that has a cavity connected to the external environment by a slot. One or more fixtures have shafts with a retainer at one end and an attachment at the other. The retainers rest on an internal surface of the support bar within the cavity and can be repositioned by sliding the fixture along the slot. The attachment may be a hook or other suitable attachment that supports stored objects for display in the external environment.

13 Claims, 3 Drawing Sheets

(56) References Cited

U.S. PATENT DOCUMENTS 3,051,318 A * 8/1962 Murphy ..... A47H 15/04 211/94.01
3,175,243 A * 3/1965 Weber ..... A47H 13/04 16/87.4 R
3,339,749 A * 9/1967 Odegaard ..... A47G 1/00 211/85.3
3,522,621 A * 8/1970 Ford ..... A47H 13/14 16/87.4 R
3,664,512 A * 5/1972 Smith ..... A47G 25/0692 211/113
3,883,924 A * 5/1975 Grabman ..... A47H 2/00 16/94 D
4,226,394 A * 10/1980 Einhorn ..... A47J 47/16 24/716
4,282,630 A * 8/1981 Toder ..... A47H 13/00 16/93 D
4,314,646 A * 2/1982 Purnell ..... A47G 7/045 211/113
4,586,616 A * 5/1986 Cooper ..... A47J 47/16 211/88.04
4,805,784 A * 2/1989 Solheim ..... A47F 5/0846 211/59.1
D353,502 S * 12/1994 Liu ..... D6/514
5,429,252 A * 7/1995 Liu ..... A47F 5/0838 211/105.1
5,547,156 A * 8/1996 Djuric ..... A47H 1/04 16/87.4 R
D392,133 S * 3/1998 Chen ..... D6/513
5,862,925 A * 1/1999 Grzywinski ..... A47G 7/045 211/113
5,908,120 A * 6/1999 Yates ..... B05B 5/082 118/500
5,960,967 A * 10/1999 Neil ..... A47F 5/0846 211/94.01
6,142,436 A * 11/2000 Thurston ..... A47B 96/067 211/100
6,158,597 A * 12/2000 McDermott ..... B42D 5/04 211/45
6,227,387 B1 * 5/2001 Rose ..... A47J 47/16 211/113
6,808,150 B1 * 10/2004 Roetenberg ..... B25H 3/04 211/162
6,976,595 B1 * 12/2005 Geller ..... A47F 5/0838 211/124
7,152,838 B2 * 12/2006 Taulbee ..... B60P 3/36 248/307
7,604,131 B1 * 10/2009 Clark ..... B62H 3/12 211/118
8,074,812 B1 * 12/2011 Bradbury ..... A47B 49/006 211/13.1
D661,526 S * 6/2012 Evans ..... D6/514
9,144,349 B2 * 9/2015 Groll ..... A47J 45/02
9,254,050 B1 * 2/2016 Bradbury ..... A47B 81/04
9,433,283 B2 * 9/2016 Hall ..... A47J 47/16
9,700,170 B1 * 7/2017 Kouts ..... F16C 29/04
D819,363 S * 6/2018 Kenjora ..... D6/569
2003/0080077 A1 * 5/2003 Ruiz ..... A47G 23/0208 211/85.29
2004/0200791 A1 * 10/2004 Bostick ..... A47B 61/02 211/94.01
2008/0245753 A1 * 10/2008 Spriegel ..... A47F 5/0892 211/85.7
2009/0272704 A1 * 11/2009 Wu ..... A47B 81/04 211/113
2020/0163471 A1 * 5/2020 Wood ..... A47F 5/0838

* cited by examiner

CONFIGURABLE STORAGE SYSTEM

BACKGROUND

1. Technical Field

The subject matter described generally relates to storage systems and, in particular, to a configurable system of movable hooks.

2. Background Information

In many situations, it is desirable to hang objects in a storage space. Jewelry, watches, and other personal items may be hung in closets. Tools may be hung in workshops. Utensils and pans may be hung in kitchens. Hanging objects may make effective use of space and make it easier to find a particular item. It may also reduce the risk of objects being damaged by getting tangled or banging together. However, existing storage systems for hanging objects suffer several limitations. For example, many systems require the intended locations for objects to be predetermined and are hard to modify to account for new or different items to be stored. Furthermore, existing solutions that allow some degree of customization often suffer from the fixtures moving unintentionally. Therefore, there is a need for improved systems for hanging objects that are customizable and reliable.

SUMMARY

The above and other problems may be addressed by configurable storage system in which fixtures may be added and removed to a support bar and slid to a desired position. In one embodiment, the support bar has an interior surface that defines a cavity and a slot connects the cavity to the exterior of the support bar. A fixture has a shaft with a stabilizer on one end and an attachment (e.g., a hook) on the other. The stabilizer rests against the interior surface of the support bar and resists rotation of the fixture while allowing the fixture to slide along the slot. The attachment enables one or more objects to be supported for display. The attachment may also contain a retainer to impede vertical motion of the attachment.

Reference will now be made to several embodiments, examples of which are illustrated in the accompanying figures. It is noted that wherever practicable similar or like reference numbers are used in the figures to indicate similar or like functionality. Where similar elements are identified by a reference number followed by a letter, a reference to the number alone may refer to all such elements, any one such element, or any combination of such elements. One skilled in the art may recognize alternative embodiments of the described structures that may be employed without departing from the principles described.

DETAILED DESCRIPTION

There are several considerations when designing a storage system for hanging objects. Beyond basic considerations such as the system being strong enough to support the weight of the object and having fixtures for securely attaching the desired objects, there are functional considerations that may make the difference between people viewing the system as good or bad. For example, people generally favor solutions that make it easy to view, hang, and remove objects. People may also favor systems that are reconfigurable to account for changes in the objects being hung without having numerous unused fixtures unnecessarily taking up space. Furthermore, people generally prefer systems that reduce the extent to which fixtures move accidentally. For illustrative purposes, the following paragraphs describe embodiments of a jewelry storage system that have some or all of these features. However, one of skill in the art will recognize that the disclosed principles and structures may be used in storage systems for other types of object.

Figure 1:
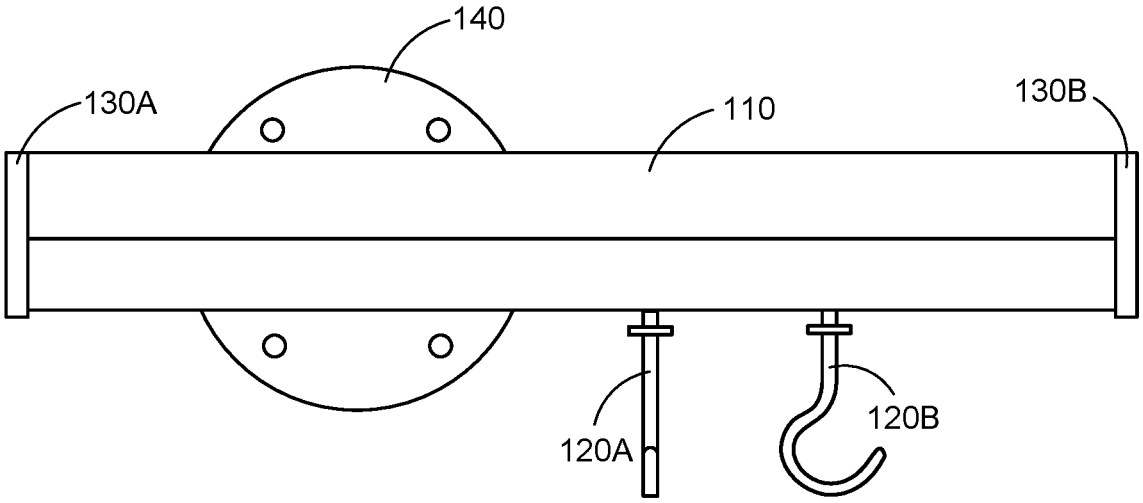
FIG. 1, illustrates a configurable storage system with movable hooks supported by a horizontal bar, according to one embodiment.

FIG. 1 illustrates one embodiment of a configurable jewelry storage system. In the embodiment shown, the system includes a support bar 110, a pair of fixtures 120, a pair of end caps 130, and a wall mount 140. In other embodiments, the system may include different or additional elements. Furthermore, the elements may be arranged differently.

In the embodiment shown in FIG. 1, the support bar 110 is a hollow bar with a substantially rectangular cross-section that has one corner removed. The removed corner creates a slot that joins the exterior of the support bar 110 to the cavity formed by the hollow interior. However, support bars 10 with other cross sections may be used. The long axis of the support bar 110 is generally parallel to the floor when the system is installed for use. However, there may be a slight angle between the long axis of the support bar 110 and the floor (e.g., up to 20 degrees).

In one embodiment, the support bar 110 is manufactured by forming a hollow bar with the desired cross section from metal (e.g., stainless steel), plastic (e.g., acrylic), wood, or any other suitable material. The slot may be formed by cutting off a portion of the support 110 (e.g., a corner in the case of a support bar with a rectangular cross section). Alternatively, a solid support bar 110 may molded with a slot and cavity of the desired profile being formed by the mold or cut into the support bar after molding. Various examples of the slot are described in greater detail below, with reference to FIGS. 3 to 5.

The fixtures 120 are for hanging the objects to be displayed. The top ends of the fixtures 120 are inside the cavity of the support bar 110 and the fixture shafts hang down through the slot. A person may slide the fixtures 120 along the support bar. In FIG. 1, the fixtures 120 include a first hook fixture 120A and a second hook fixture 120B. The first hook fixture 120A is angled such that the end of the hook projects forward, out of the plane of the drawing. The second hook fixture 120B is angled such that the hook curves in the plane of the drawing. Note that although the fixtures 120 shown both use hooks, other types of attachment may be used, such as clips, snaps, or magnets, depending on the objects to be hung. Various embodiments of the fixtures 120 are described in greater detail below, with reference to FIG. 2.

At least a portion of one or both ends of the support bar 110 are open to enable fixtures 120 to be added or removed. The end caps 130 seal the open ends of the support bar 110. For example, a person may remove an end cap 130, add or remove fixtures 120 as desired, and then replace the end cap to prevent fixtures from falling out of the ends of the support bar 10 accidentally. In one embodiment, the end caps 130 are made of the same material as the support bar 110. Alternatively, other suitable materials may be used. In another embodiment, there may be one or more portions of the slot that are large enough to allow addition and removal of fixtures 120 instead of or in addition to adding and removing fixtures via the ends of the support bar 110. For example, the slot may be wider in a central portion of the support bar 110 to allow a person to slide fixtures 120 to the middle and remove them, or add new fixtures and slide them towards one end for use. In such embodiments, one or both end caps 130 may be permanently attached, or the ends of the support bar 110 be sealed.

The wall mount 140 may be used to attach the system to a wall or other suitable surface. In the embodiment shown in FIG. 1, the wall mount 140 is a circular disc with four screw holes for affixing the system to a suitable surface. A shaft (not shown) extends from the center of the disc and connects to the back of the support bar 110. The wall mount may be made from the same material as the support bar 110 or any other suitable material. In other embodiments, the system may include more than one wall mount (e.g., one at each end) to provide greater support and other designs of wall mount may be used. Alternatively, one or both ends of the support bar 110 may be mounted by inserting the end of the bar into a hole in a mounting bracket or wall.

Figure 2A:
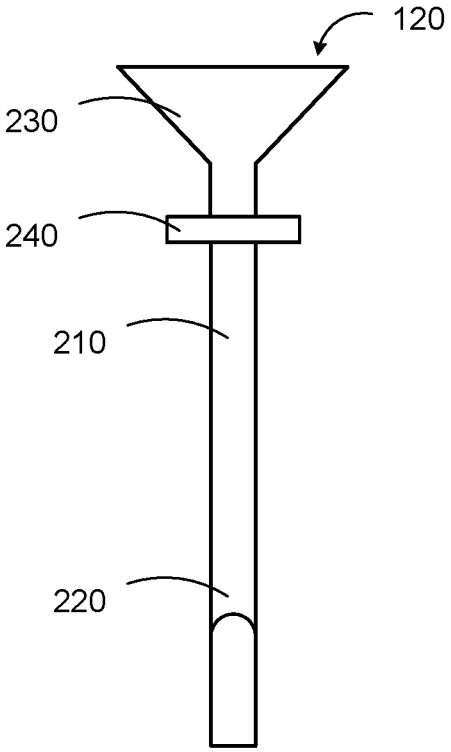
FIG. 2A is a front view of one of the hooks shown in FIG. 1, according to one embodiment.
Figure 2B:
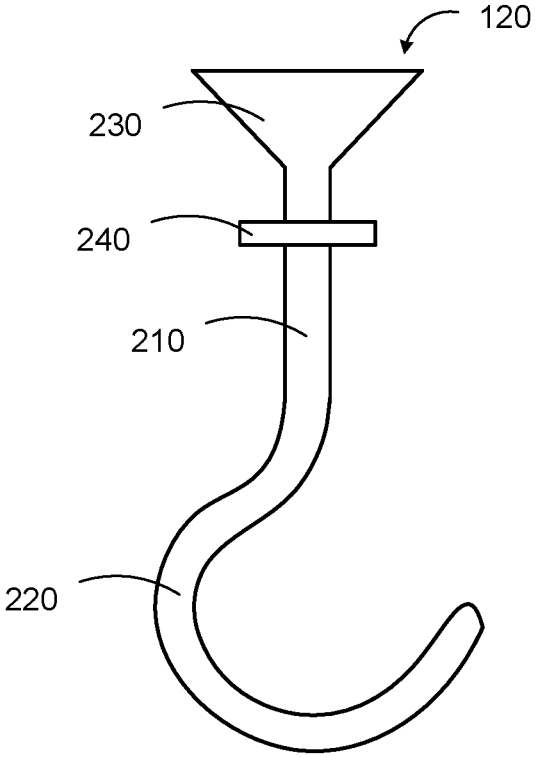
FIG. 2B is a side view of one of the hooks shown in FIG. 1, according to one embodiment.

FIGS. 2A and 2B illustrate one embodiment of a hook fixture 120. FIG. 2A is a front view of the hook fixture 120 and FIG. 2B is a side view of the hook fixture. In the embodiment shown, the hook fixture 120 includes a shaft 210 with a hook 220 on one end. A stabilizer 230 is on the other end of the shaft. There is also a retainer 240 on an upper portion of the shaft 210. In other embodiments, the fixture 120 may include different, additional, or fewer elements. For example, the retainer 240 may be omitted.

In various embodiments, the shaft 210 is between one and five centimeters long and the hook 220 is an approximately circular arc with a radius between one and five centimeters. In another embodiment, the hook 220 is formed by a set of substantially straight portions at angles relative to each other. For example, a first portion may angle back from the shaft 210 at approximately forty-five degrees, a second portion may extend at approximately forty-five degrees from the first portion, approximately parallel to the floor, and a third portion may extend up from the second portion at approximately ninety degrees, approximately parallel to the shaft 210. In other embodiments, other sizes and shapes of hook 220 may be used, depending on the objects to be hung.

The stabilizer 230 resists rotation of the fixture 120 around the long axis of the shaft 210. In one embodiment, the stabilizer 230 is an inverted, square based pyramid. The stabilizer 230 is large enough that it cannot readily pass through the slot. For example, the sides of the pyramid base may be between five millimeters and three centimeters and the slot may be between one millimeter and two centimeters wide. When the hook fixture 120 is installed on the support bar 110, the stabilizer 230 rests on the interior surface of the support bar under gravity. The contact between surfaces of the stabilizer and the interior of the support bar 110 prevents the hook fixture 120 from rotating. Thus, the hook fixture 120 generally maintains the same orientation relative to the support bar 110. In other embodiments, the stabilizer 230 may have other shapes, depending on the shape of the corresponding cavity within the support bar 210.

The retainer 240 includes one or more protrusions from the side of the shaft 210 that prevent (or at least make it more difficult for) the shaft to be pushed up into the cavity through the slot. In one embodiment, the retainer 240 is a disc that has a diameter larger than the width of the slot (e.g., between five millimeters and three centimeters). In other embodiments, the retainer 240 is a square, hexagon, or any other protrusion that has a cross section perpendicular to the long axis of the shaft 210 that is larger than the width of the slot. The retainer 240 may be an integral part of the shaft 210 or a separate component coupled to the shaft.

The fixtures 120 may be made from any suitable material or materials. For example, the shaft 210 and hook 220 may be stainless steel or plastic while the stabilizer 230 and retainer 240 may be rubber or silicone. In some embodiments, the material of the stabilizer 230 or retainer 240 may be selected to have relatively high friction with the corresponding surfaces of the support bar 110 to reduce the likelihood of the fixture 120 sliding along the slot accidentally. In other embodiments, the material of the stabilizer 230 or retainer 240 may be selected to be slick and smooth to facilitate easy sliding of the fixture 120 along the slot.

Figure 3:
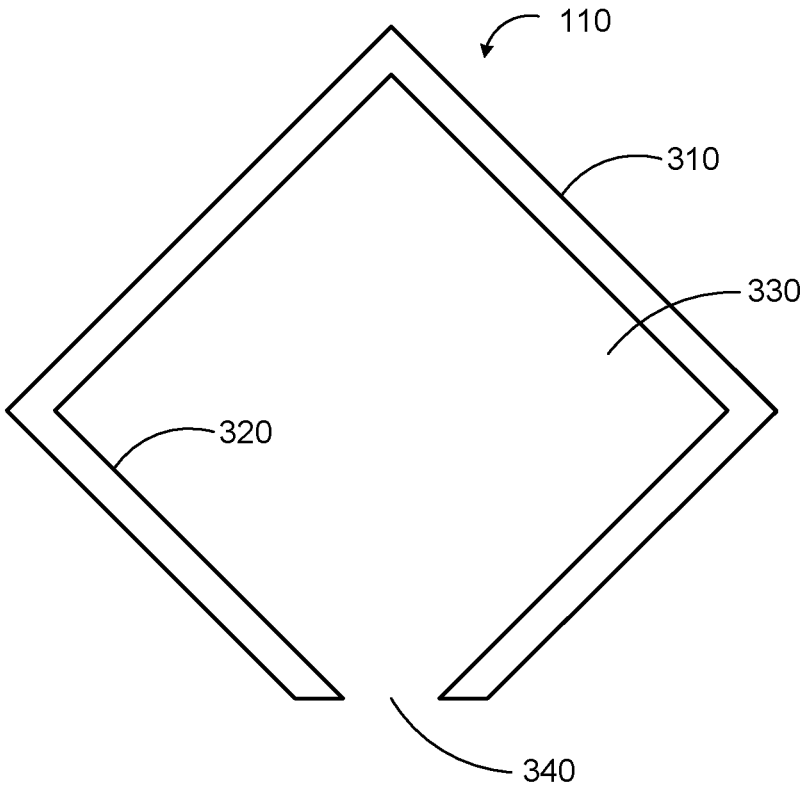
FIG. 3 is a cross-section of the horizontal bar shown in FIG. 1, according to one embodiment.

FIG. 3 is a cross-section of an embodiment of the support bar 110. In the embodiment shown, the support bar 110 is hollow having an exterior surface 310 and an interior surface 320. The interior surface 320 defines a cavity 330 within the support bar 110 and a slot 340 connects the cavity 330 to the external environment. As described previously, the slot 340 may be formed by cutting off a corner of the support bar 110. Thus, the cross-section is substantially but not completely square. Furthermore, although the corners are shown as sharp ninety-degree angles, more gradual curves may be used to increase the strength of the support bar 110.

Figure 4:
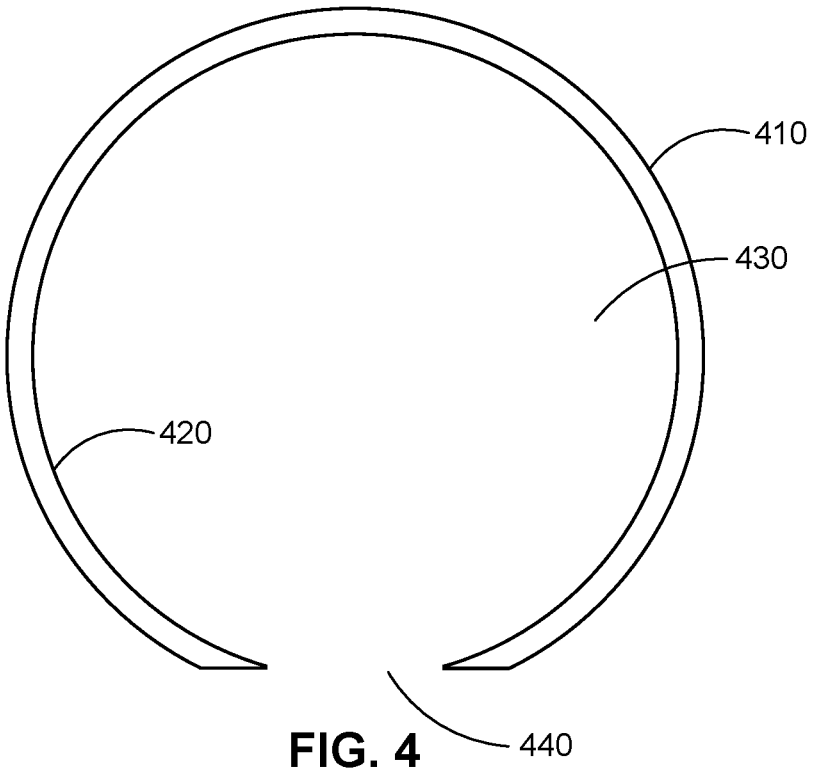
FIG. 4 is a cross-section of an alternate design for the horizontal bar, according to one embodiment.

FIG. 4 is a cross-section of an alternate embodiment of the support bar 110. The embodiment shown in FIG. 4 has a substantially circular cross-section. As with the square cross-section embodiment, the support bar 110 has an exterior surface 410 and an interior surface 420. Similarly, the interior surface 420 defines a cavity 430 that is connected to the exterior environment by a slot 440. In other embodiments, support bars 110 with other geometries may be used (e.g., with cross-sections that are triangular, hexagonal, etc.).

Figure 5:
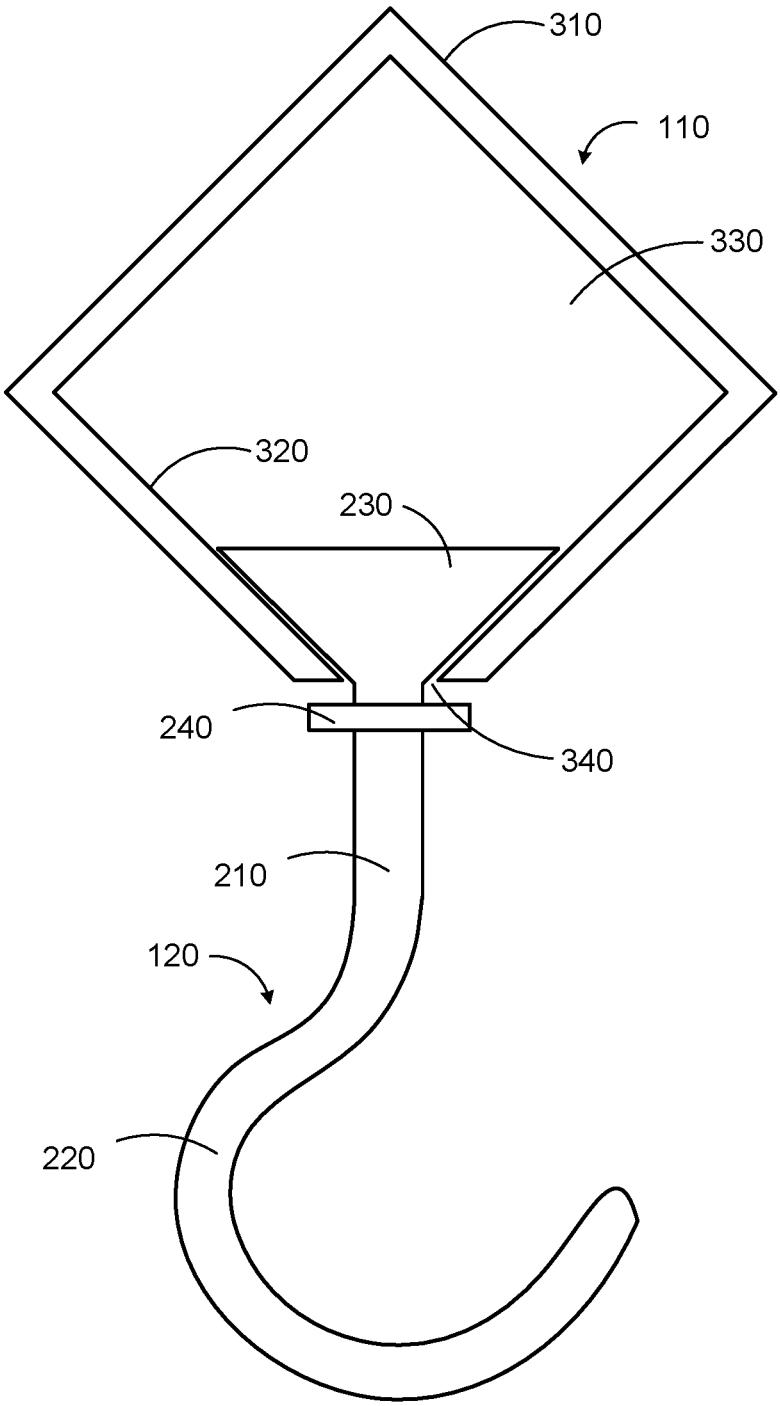
FIG. 5 illustrates how the horizontal bar supports a hook, according to one embodiment.

FIG. 5 illustrates one embodiment of a system including a hook fixture 120 installed on a support bar 110. The surfaces of the stabilizer 230 rests against the interior surface 320 of the support bar 110. In this embodiment, the stabilizer 230 is an inverted pyramid. Thus, once the stabilizer is settled into the slot 340 it cannot rotate without being lifted up. However, the hook fixture 120 remains free to slide along the slot 340 and thus be repositioned along the support bar 110 (subject to friction).

The shaft 210 extends through the slot 340 and thus the hook 220 is available for hanging jewelry or other items. In the embodiment shown, the retainer 240 is a short distance from the exterior surface 310 of the support bar 110 when the stabilizer 230 is settled in the slot 340. Thus, the hook fixture 120 may only be lifted a small distance before the retainer 240 contacts the exterior surface 310, preventing further upward movement. Alternatively, the retainer 240 may contact (or be moved to contact) the exterior surface 310 when the stabilizer 230 is settled in the slot 340. Thus, the retainer 240 may provide additional friction opposing lateral motion of the hook fixture 120 along the slot 340. In one embodiment, the retainer 240 is an integral part of the hook fixture 120. In another embodiment, the retainer 240 is a washer or other component that may be slid up and down the shaft 210 to adjust the possible amount of vertical movement of the hook fixture 120.

As used herein, any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Similarly, use of "a" or "an" preceding an element or component is done merely for convenience. This description should be understood to mean that one or more of the element or component is present unless it is obvious that it is meant otherwise.

Where values are described as "approximate" or "substantially" (or their derivatives), such values should be construed as accurate +/−10% unless another meaning is apparent from the context. From example, "approximately ten" should be understood to mean "in a range from nine to eleven."

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Upon reading this disclosure, those of skill in the art will appreciate still additional alternative structural and functional designs for a configurable storage system. Thus, while particular embodiments and applications have been illustrated and described, it is to be understood that the described subject matter is not limited to the precise construction and components disclosed. The scope of protection should be limited only by the following claims.

What is claimed is:

1. A storage system comprising:

a support bar having an interior surface defining a cavity, wherein a slot connects the cavity to an exterior environment of the support bar; and a fixture including:

a shaft having a first end and a second end, the second end opposite the first end relative to a longitudinal axis of the shaft;

a stabilizer comprising an inverted square-based pyramid coupled to the first end of the shaft such that opposing planar surfaces of the inverted square-based pyramid rest against and contact corresponding planar surfaces of the interior surface of the support bar under gravity when the stabilizer is disposed within the cavity, wherein the contact of the stabilizer's planar surfaces with the planar surfaces of the interior surface resists rotation of the fixture around the longitudinal axis while allowing the fixture to slide along at least a portion of the slot;

an attachment portion coupled to the second end of the shaft and configured to support an object in the exterior environment; and an adjustable retainer coupled to the shaft and configured to move along the shaft from a first position to a second position, wherein in the first position, the retainer resists vertical movement of the fixture, thereby resisting rotation of the fixture, and wherein in the second position, the retainer allows vertical movement of the fixture, thereby allowing rotation of the fixture.

2. The storage system of claim 1, wherein the support bar has a substantially rectangular cross-section.

3. The storage system of claim 2, wherein a corner of the rectangular-cross section is absent, the absent corner defining the slot.

4. The storage system of claim 1, wherein an end of the support bar is at least partially open and configured to enable the fixture to be added to or removed from the support bar.

5. The storage system of claim 4, further comprising an end cap configured to engage with the end of the support bar, wherein the end cap prevents addition or removal of the fixture when engaged with the end of the support bar.

6. The storage system of claim 1, wherein the attachment portion is a hook, clip, snap, or magnet.

7. The storage system of claim 1, wherein the retainer is a disc.

8. The storage system of claim 1, wherein the retainer is a distinct component from the shaft.

9. The storage system of claim 1, wherein the retainer comprises rubber or silicone.

10. The storage system of claim 1, further comprising a mount coupled to the support bar and configured to secure the support bar to a surface.

11. The storage system of claim 1, wherein the support bar comprises metal or plastic.

12. The storage system of claim 1, wherein the fixture comprises metal or plastic.

13. The storage system of claim 1, wherein the object is an item of jewelry, a watch, a tool, or a kitchen utensil.

* * * * *